United States Patent [19]

Bayer et al.

[11] 4,266,888

[45] May 12, 1981

[54] SPHERICAL JOINT FOR CONNECTING A CONCRETE TOWER SUPPORTING A WATER SURFACE FOUNDATION TO A SEA FOUNDATION

[75] Inventors: Karl Bayer, Stuttgart-Wangen; Heinz G. Butt, Pinneberg; Jürgen Salewski, Hamburg, all of Fed. Rep. of Germany

[73] Assignees: Gutehoffnungshütte Sterkrade AG; Fa. Bilfinger & Berger, both of Fed. Rep. of Germany

[21] Appl. No.: 969,689

[22] Filed: Dec. 14, 1978

[30] Foreign Application Priority Data

Dec. 14, 1977 [DE] Fed. Rep. of Germany ..... 2755592

[51] Int. Cl.[3] ..... E02B 17/00

[52] U.S. Cl. ..... 405/202; 285/261; 405/195

[58] Field of Search ..... 405/195–208; 285/51, 52, 260–264

[56] References Cited

U.S. PATENT DOCUMENTS

| | | | |
|---|---|---|---|
| 2,998,270 | 8/1961 | Watkins | 285/51 X |
| 3,182,452 | 5/1965 | Eldred | 285/261 X |
| 3,475,039 | 10/1969 | Ortloff | 285/261 X |
| 3,522,709 | 8/1970 | Vilain | 405/202 |
| 3,811,713 | 5/1974 | Barrett et al. | 285/263 X |
| 4,069,682 | 1/1978 | Taylor et al. | 405/202 |
| 4,137,722 | 2/1979 | Messiossian et al. | 405/202 |
| 4,155,670 | 5/1979 | Stafford | 405/202 |

*Primary Examiner*—Dennis L. Taylor
*Attorney, Agent, or Firm*—John J. McGlew

[57] ABSTRACT

A joint connection between a concrete tower supporting a surface platform and a sea anchorage or foundation, comprises, an outer hemispherical socket shell which is adapted to be secured to the concrete tower and an inner head which has a hemispherical shell portion within the outer shell portion and a lower cylindrical portion which extends downwardly therefrom and is secured to a foundation plate having an opening therethrough for the passage of conveying lines. Lubricated slide shoe elements are disposed between the inner and outer shells to facilitate their pivotal interengagement. A support gimbal is secured within the inner head and a pull rod is connected to the gimbal and extends upwardly through the head and the outer shell and is connected to a beam mounted on the concrete foundation above hydraulic presses. The hydraulic presses comprise prestressing means connected to the pull rod to prestress it in a direction to urge the inner and outer shells into pivotal interengagement. The construction includes a bellows-like apron stretched between the outer shell and the baseplate as well as an outer tire-like apron engaged between the outer shell and the baseplate so as to define two annular inner spaces around the inner shell to seal the joint against sea contamination. Sealing liquid may be supplied into each annular space and to the lubricating shoes.

23 Claims, 2 Drawing Figures

SPHERICAL JOINT FOR CONNECTING A CONCRETE TOWER SUPPORTING A WATER SURFACE FOUNDATION TO A SEA FOUNDATION

FIELD AND BACKGROUND OF THE INVENTION

This invention relates to anchorages in general and, in particular, to a new and useful connection between a concrete tower supporting a surface platform and a foundation anchored to the sea bottom.

DESCRIPTION OF THE PRIOR ART

Such joints are already known, for example, from U.S. Pat. No. 3,522,709. This prior art joint, however, only permits pivoting in a vertical plane and additional mechanisms of the kind of a universal joint are required to ensure pivoting in all directions. The elements of the joint, in addition, are exposed to sea water attack which, in the long run, may lead to damages caused by corrosion.

A moving joint which permits pivotal motion in all directions is disclosed in German OS No. 2,549,859. This connection, designed as a spherical joint and provided with a pull member and pivotable in any direction, makes it possible to run therethrough conveying lines for liquid or gaseous fluids, for example, petroleum, natural gas or the like. This connection is also exposed to sea water attack. The outside surface of the spherical head may only be checked for the presence of corrosion by divers.

SUMMARY OF THE INVENTION

Starting from such a spherical joint, comprising a spherical head and a spherical socket, and a pull member connecting both parts and conveying lines run through the joint, the present invention is directed to a joint which ensures mobility with ease even under the most difficult operational conditions by a reduced sliding friction, and is capable of maintaining this mobility permanently, even under attack by sea water.

In accordance with the invention, there is provided a joint connection between the tower supporting a surface platform and a sea anchorage which comprises an outer hemispherical socket shell which is adapted to be secured to the concrete tower and an inner head having a hemispherical shell portion within the outer shell and with lubricated slide shoes disposed therebetween to permit their pivotal interengagement. A horizontal baseplate is secured to a cylindrical lower extension or lower portion of the inner head and it has an opening therethrough defining a line conveying passage.

A support gimbal is secured to the inner head and a pull rod is connected to the support gimbal and extends upwardly through the inner head and an opening of the outer shell. Prestressing means are connected to the pull rod to prestress it in a direction to urge the inner head into pivotal interengagement with the outer shell. Bellows-like aprons are extended between the outer shell and the baseplate so as to define two separate annular spaces which may be filled with a sealing liquid to protect the joint.

It is advantageous for the assemblage of the spherical joint to design the inner hemispherical shell with unequal radii of the spherical shape. That is, the upper spherical portion provided with a central bore has a smaller radius than the lower spherical portion which is secured through a cylindrical portion to a baseplate to which the pull member is also anchored.

In order to securely transfer the occurring tensional forces to the outer hemispherical shell with a minimum friction, it is necessary to provide the slide elements which are disposed between the hemispherical shells in a shape corresponding to the unequal radii of the spherical surfaces. Since the radius of the upper spherical portion is smaller, the thickness of the slide elements, which are designed as slide shoes coated with a PTFE layer, is increased in this zone, which facilitates the assembly thereof.

In order to maintain the operational capability of the spherical joint at the occurrence of wear, it is advantageous to make the slide shoes exchangeable. In one embodiment of the invention, it is provided that the slide shoes are designed as Neotopf slide bearings with the PTFE contact coating and in a shape corresponding to the geometry of the gap between the hermispherical shells. PTFE as a contact layer has the advantage of being resistant to aging and having the smallest frictional resistance of all of the conventional materials. Further reduction of the friction is obtained by providing a high-pressure lubrication system supplying the slide shoes or Neotopf bearings individually and independently of one another.

To be able to exchange the slide shoes, the outer hemispherical shell provided in the lower portion of the concrete tower must be lifted by some tenths of a millimeter. For this purpose, the connection of the pull member is somewhat released, so that the outer hemispherical shell is uplifted from the inner hemispherical shell due to the buoyancy of the concrete tower and the present lubricant pressure. The slide shoes or Neotopf bearings, which are slightly conical, may then be exchanged one after the other. To avoid leakage losses, only the zone of the respective slide element to be exchanged is pressureless.

Only a small wear of the slide shoes or Neotopf bearings occurs if the inside slide surface of the outer hemispherical shell facing the PTFE slide layer is provided with a corrosion-resistant material which is applied to the base material by plating or welding and is then polished to a mirror finish. This provides the best sliding conditions. A satisfactory lubricant distribution is obtained if the coated slide surface is subdivided into a plurality of sectors facing the respective PTFE layers on the Neotopf slide bearings.

The spherical joint is secured against sea water attack by providing a tire-shaped sealing body stiff against torsion which is designed as a straining bellows and is disposed between the baseplate supporting the inner hermispherical shell and a flange terminating the outer hemispherical shell.

Aside from protecting the spherical joint against sea water attack, the torsion-stiff straining bellows also absorbs the occurring torque about the vertical axis of the concrete tower. This makes a further securing against torsion within the spherical joint unnecessary. At the same time, the straining bellows balances the tilting motion between the concrete tower and the foundation.

In accordance with the invention, the high mechanical loads can be absorbed in view of the provision that the straining bellows is made of a carcass on which a quality rubber which is resistant to oil and sea water and unsusceptible to marine growth is vulcanized. An additional security for the spherical joint is obtained by providing a cylindrical, bellows-like apron within the straining bellows. A compression of the straining bellows by the water pressure is prevented by filling the interior spaces with a sealing liquid. For this purpose, separate filling and venting lines must be provided for each of the interior spaces, which are connected to supply tanks placed in the surface are and filled with the sealing liquid. These supply tanks are provided outside of the concrete tower or within the same. They may also be designed as floating bodies with flexible connecting lines.

It may be advantageous if, in accordance with a development of the system of sealing means supply, a second liquid line is provided between the spaces surrounded by the straining bellows and the supply tanks, which line opens into the tanks from above, so that pressure variations in the spaces surrounded by the straining bellows which are due to the water level variations or to leakage, for example, are compensated by a natural circulation of the sealing means.

In accordance with the present invention, it is also advantageous to employ oil as the sealing liquid. An additional monitoring oil circuit is provided permitting the checking of whether sea water has leaked into the interior space directly adjacent the surrounding sea water, i.e., the space between the sealing body and the inner apron. In this circuit, the oil is taken in in the bottom zone, connected through a monitoring means, for example, a sight glass, and is then recycled into the annular space.

The outer shell, i.e., the socket, is connected to the inner hemispherical shell, i.e., the spherical head, in a known manner, by a pull member which is pivotable in all directions and comprises a pull rod which is mounted in a yoke supported by the concrete structure and can be prestressed. The adjustment of a permanently constant initial stress is a prerequisite for a uniform loading of the slide shoes between the hemispherical shells and thus for their extended life. In accordance with the invention, the design is such that the initial stress in the pull member is produced by hydraulic presses which are disposed between the yoke and a crossbeam supported by the extended pull rod. The actual tensional stress is permanently monitored by means of known measuring devices.

Accordingly, an object of the present invention is to provide a joint connection between a concrete tower supporting a surface platform and a sea foundation, which comprises, an outer hemispherical socket shell adapted to be secured to the concrete tower, an inner head having a hemispherical shell portion within the outer socket shell and having a lower portion extending downwardly from said outer shell portion, with lubricated slide shoe means disposed between the inner head and the outer socket shell and further including a horizontal baseplate secured to the lower portion of the inner head and having an opening therethrough defining a line conveying passage and with a support gimbal secured to the inner head connected to a pull rod which extends upwardly through the head and is connected to prestressing means to prestress it in a direction to urge the inner head into pivotal interengagement with said outer shell and further including cover means connected the outer shell and the baseplate to protect the pivotal interengagement of the inner head and the outer shell.

A further object of the invention is to provide a spherical joint which is simple in design, rugged in construction and economical to manufacture.

For an understanding of the principles of the invention, reference is made to the following description of a typical embodiment thereof as illustrated in the accompanying drawing.

DESCRIPTION OF THE PREFERRED EMBODIMENT

Figure 1:
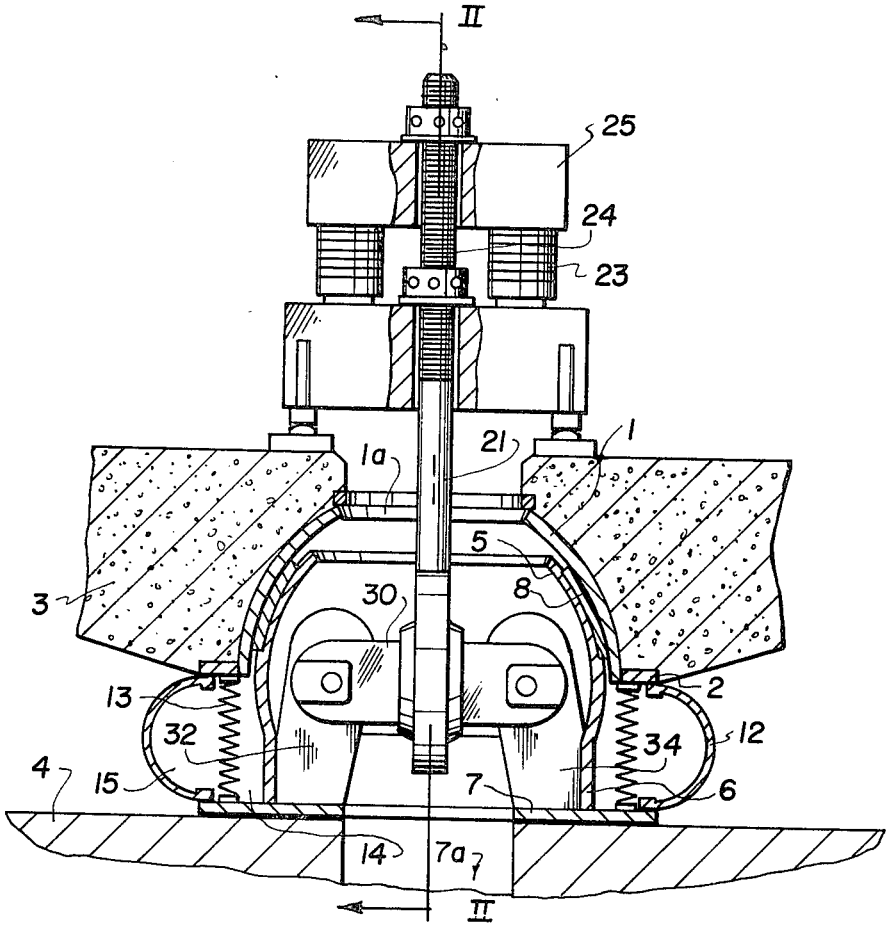
FIG. 1 is a transverse sectional view of a spherical joint for a sea anchorage constructed in accordance with the invention.
Figure 2:
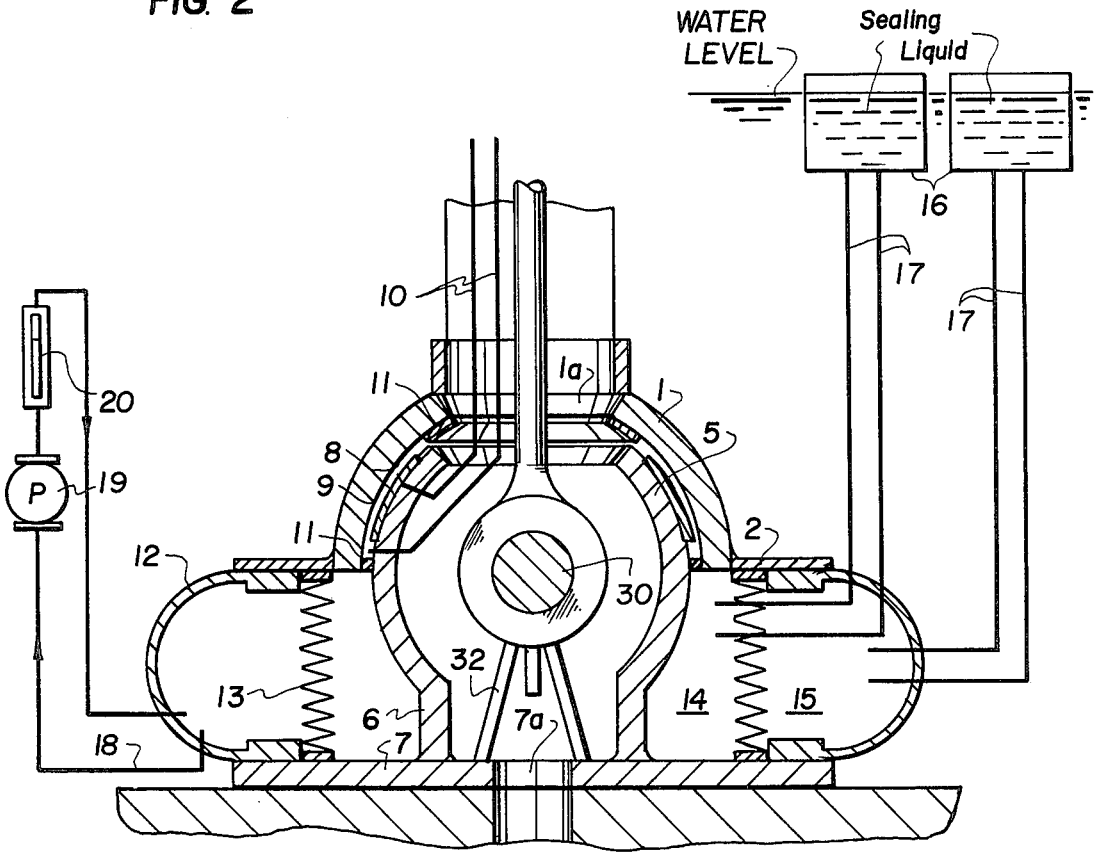
FIG. 2 is a section taken along the line II—II of FIG. 1.

Referring to the drawing in particular, the invention embodied therein, comprises, a joint connection between a concrete tower having a concrete tower portion 3, which supports a surface platform on a foundation 4. The joint comprises an outer hemispherical socket shell adapted to be secured to the concrete tower 3 and an inner head having a hemispherical shell portion 5 within the outer shell portion 1 and having a lower cylindrical portion 6 extending downwardly from the outer shell and secured to a baseplate 7 which is mounted on a foundation 4.

Horizontal baseplate 7 has an opening therethrough defining a line conveying passage 7*a*. A support gimbal 30 is mounted for some pivotal movement in supporting brackets 32 and 34 which are secured to the cylindrical portion 6 and the baseplate 7. A pull rod 21 is connected to the gimbal 30 and extends upwardly therefrom through an opening 1*a* in the outer shell portion 1. Prestressing means are connected to the pull rod 21 so as to prestress it in a direction to urge the inner head 5 and the outer shell portion 8 into pivotal interengagement.

Lubricated slide shield means 8 are disposed between the inner head 5 and the outer shell portion 8 to permit their interengagement with minimum frictional contact. Cover means in the form of a bellows-like apron 13 is disposed between a flange 2 of the outer shell portion 5 and the baseplate 7 and a tire-shaped cover or apron 12 extending between the flange 2 and baseplate 7 defines annular spaces 14 and 15 around the lower opening of the joint between the outer shell portion 1 and the inner head 5.

The outer hemispherical shell 1, i.e. the spherical socket, is provided with a flange 2 and is firmly anchored in a recess of a concrete tower 3 which is connected to a foundation 4 by means of the inventive spherical joint. The inner hemispherical shell 5, i.e. the spherical head, is firmly connected through a cylindrical portion 6 to a baseplate 7 of the foundation. Exchangeable slide shoes 8 are provided between hemispherical shells 1 and 5. The opposite slide surface 9 is coated with a material which is resistant to corrosion and mirror-finished.

In order to reduce the fricture further, the zone of sliding contact is supplied with lubricant from a high-pressure lubricating system 10, and is secured against leakage and penetrating external matter by means of special seals 11. To protect the spherical joint against sea water attack, a tire-shaped straining bellows 12, stiff against torsion, is provided between flange 2 and baseplate 7, the interior of which is sealed in addition by a cylindrical bellows-like apron 13.

Consequently, the spherical joint is surrounded by two inner spaces 14 and 15 separated from each other, which are filled with a sealing liquid to withstand the water pressure from the outside. The filling and simultaneous venting is effected through separate lines 17 from supply tanks 16 which are provided in the surface area. Sealing liquid, preferably oil, is conveyed through another line 18 from inner space 15 through a pump 19 to a monitoring means 20, for example a sight glass, to check whether sea water has leaked into inner space 15.

The frictional connection under pressure of the two hemispherical shells 1 and 5 is effected, in a known manner, through a pull member pivotable in every direction, whose hinges are supplied from an independent lubricating system and whose pull rod 21 is mounted in yoke 22. A permanently constant initial stress in the pull rod is produced by hydraulic presses 23 which are disposed between yoke 22 and a crossbeam 25 supported by the extended pull rod 24.

While specific embodiments of the inventio have been shown and described in detail to illustrate the application of the principles of the invention, it will be understood that the invention may be embodied otherwise without departing from such principles.

What is claimed is:

1. A joint connection between a concrete tower supporting a surface platform in a sea foundation, comprising an outer hemispherical socket shell adapted to be secured to the concrete tower, an inner head having a hemispherical shell portion within said outer hemispherical socket shell and having a lower portion extending downwardly from said shell portion, lubricated slide shoe means disposed between said hemispherical shell portion of said inner head and said outer hemispherical socket shell, a horizontal base plate secured to said lower portion of said inner head and having an opening therethrough defining a line conveying passage, a support gimbal secured to said inner head, a pull rod connected to said support gimbal and extending upwardly therefrom, and prestressing means connected to said pull rod to prestress it in a direction to urge said hemispherical shell portion of said inner head into pivotal interengagement with said outer hemispherical socket shell, and cover means connected between said base plate and said outer hemispherical socket shell to protect the pivotally interengaged hemispherical shell portion of said inner head and said outer hemispherical socket shell.

2. A joint connection according to claim 1, wherein said hemispherical shell portion has unequal radii over its surface.

3. A joint connection according to claim 1 wherein said slide shoe means comprise hemispherical portions corresponding to the radii of said hemispherical shell.

4. A joint construction according to claim 1 wherein said slide shoe means comprises plate members having a PTFE coating thereon.

5. A joint connection according to claim 1 wherein said slide shoe means comprise exchangeable plates.

6. A joint connection according to claim 1 wherein said slide shoe means comprise Neotopf slide bearings having slide coatings of PTFE and a geometry corresponding to the geometry of the space between said hemispherical portion of said inner head and said outer hemispherical socket shell.

7. A joint construction according to claim 7 including means for directing a lubricant under high pressure to said slide shoe plates independently of each other.

8. A joint according to claim 7 wherein said interengaged surfaces of said hemispherical shell portion of said inner head and said hemispherical socket shell include at least one surface with PTFE slide coating thereon of a material resistant to corrosion.

9. A joint connection according to claim 8 wherein said coating comprises a plate coating which is mirror-finished.

10. A joint connection according to claim 9 wherein said material resistant to corrosion is welded to the base material and then mirror-finished.

11. A joint connection according to claim 1 wherein said slide shoe means comprises individual plates of sector configuration forming Neotopf slide bearings having a PTFE slide coating thereon.

12. A joint according to claim 1 wherein said cover means includes an outer tire shaped sealing body between the lower end of said outer hemispherical socket shell and said base plate, said lower portion of said outer cylindrical shell having a flange engaged with said tire shaped sealing body.

13. A joint connection according to claim 1 wherein said cover means includes a straining bellows provided between said outer hemispherical socket shell and said base plate.

14. A joint connection according to claim 12 wherein said straining bellows comprises a carcass on which a rubber of a quality resistant to oil and seawater and unsusceptible to marine growth is volcanized.

15. A joint connection according to claim 12 wherein a cylindrical bellows-like apron is provided inside of said straining bellows between said outer hemispherical socket shell and said base plate.

16. A joint connection according to claim 1 wherein said cover means define two separate annular spaces exterior of said inner head and filled with a sealing liquid.

17. A joint according to claim 16 including a supply of sealing liquid disposed above said joint and filling and venting lines connected into each space and to said sealing liquid supply.

18. A joint connection according to claim 17 including a separate sealing liquid supply tank for each annular space, each having a separate venting line and filling line connected between the tank and the associated space.

19. A joint connection according to claim 18 wherein said supply tanks are located outside of said concrete tower.

20. A joint connection according to claim 18 wherein said supply tanks comprise floating bodies with flexible rise lines.

21. A joint connection according to claim 1 wherein the space between said cover means and said inner head is filled with a sealing liquid comprising oil.

22. A joint connection according to claim 20 wherein there are two separate annular spaces around said inner head and including a monitoring connection to the inner space in order to determine whether the space is filled with seawater.

23. A joint connection according to claim 1 wherein said prestressing means includes a hydraulic press, a crossbeam mounted on said concrete tower, said pull rod being connected to said crossbeam and said hydraulic press acting on said crossbeam to prestress said pull rod.

* * * * *